US006847034B2

(12) United States Patent
Shah et al.

(10) Patent No.: US 6,847,034 B2
(45) Date of Patent: Jan. 25, 2005

(54) DOWNHOLE SENSING WITH FIBER IN EXTERIOR ANNULUS

(75) Inventors: Vimal V. Shah, Sugar Land, TX (US); Wallace R. Gardner, Houston, TX (US); Paul F. Rodney, Spring, TX (US); Neal G. Skinner, Lewisville, TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 42 days.

(21) Appl. No.: 10/237,470

(22) Filed: Sep. 9, 2002

(65) Prior Publication Data

US 2004/0047534 A1 Mar. 11, 2004

(51) Int. Cl.[7] ..... G01V 8/00; E21B 47/00

(52) U.S. Cl. ..... 250/269.1; 250/227.14; 250/227.27; 250/256; 166/250.01; 166/254.2

(58) Field of Search ..... 250/269.1, 227.14, 250/227.27, 256; 166/250.01, 254; 385/12

(56) References Cited

U.S. PATENT DOCUMENTS

| | | | | |
|---|---|---|---|---|
| 5,767,411 | A | 6/1998 | Maron | 73/705 |
| 5,892,860 | A | 4/1999 | Maron et al. | 385/12 |
| 5,925,879 | A | 7/1999 | Hay | 250/227.14 |
| 5,973,317 | A | 10/1999 | Hay | 250/227.14 |
| 5,986,749 | A | 11/1999 | Wu et al. | 356/73.1 |
| 5,992,250 | A | 11/1999 | Kluth et al. | |
| 6,016,702 | A | 1/2000 | Maron | 73/705 |
| 6,041,872 | A | 3/2000 | Holcomb | 175/40 |
| 6,227,114 | B1 | 5/2001 | Wu et al. | 102/201 |
| 6,233,746 | B1 | 5/2001 | Skinner | 2/227.18 |
| 6,252,656 | B1 | 6/2001 | Wu et al. | 356/73.1 |
| 6,271,766 | B1 | 8/2001 | Didden et al. | 340/853.1 |
| 6,281,489 | B1 | 8/2001 | Tubel et al. | 250/227.14 |
| 6,317,540 | B1 | 11/2001 | Foulger et al. | |
| 6,355,928 | B1 * | 3/2002 | Skinner et al. | 250/269.1 |
| 6,437,326 | B1 * | 8/2002 | Yamate et al. | 250/269.1 |
| 6,531,694 | B2 * | 3/2003 | Tubel et al. | 250/227.14 |
| 6,644,402 | B1 * | 11/2003 | Sharma et al. | 168/250.01 |
| 2003/0094281 | A1 | 5/2003 | Tubel | |
| 2003/0205376 | A1 | 11/2003 | Ayoub et al. | |

FOREIGN PATENT DOCUMENTS

| | | | |
|---|---|---|---|
| FR | 2697283 | A1 | 4/1994 |

* cited by examiner

*Primary Examiner*—John R. Lee
*Assistant Examiner*—Paul M. Gurzo
(74) *Attorney, Agent, or Firm*—John W. Wustenberg; Anthony L. Rahhal

(57) ABSTRACT

A portion of at least one fiber is moved into an exterior annulus of a well between a tubular structure in the well and the wall of the borehole of the well such that the portion is placed to conduct a signal responsive to at least one parameter in the exterior annulus. One particular implementation uses fiber optic cable with a cementing process whereby flowing cementing fluid pulls the portion of the cable into the exterior annulus.

33 Claims, 3 Drawing Sheets

DOWNHOLE SENSING WITH FIBER IN EXTERIOR ANNULUS

BACKGROUND OF THE INVENTION

This invention relates generally to sensing conditions in an exterior annulus between a casing, liner, or other tubular structure and the wall of the borehole of a well. It relates more particularly to sensing, such as with optical fiber technology, one or more parameters in such exterior annulus at least during a cementing treatment.

Service companies in the oil and gas industry strive to improve the services they provide in drilling, completing, and producing oil and gas wells. Cementing is a well-known type of service performed by these companies, and it entails the designing, producing, and using of specialized fluids. Typically, such a fluid is pumped into a well so that the fluid flows into the exterior annulus between a tubular structure, typically a casing or a liner, and the wall of the borehole. It would be helpful in obtaining, maintaining, and monitoring these fluids and flows to know downhole conditions as these fluids are being placed in wells, and especially in the exterior annulus of a well where data has not heretofore been readily obtained directly. Thus, there is a need for sensing these conditions and obtaining data representing these conditions from inside the exterior annulus at least as the fluids are being placed (that is, in real time with the treatment processes); however, post-treatment or continuing sensing is also desirable (such as for trying to determine progress of setting or hardening, for example). Such need might include or lead to, for example, monitoring pressure, temperature, and other parameters inside the exterior annulus and within the flow of cement or other fluid itself, monitoring cement setting and hardening times, estimating cementing job quality, improving treatment models, and enhancing correlation between actual cement setting times and laboratory-based results.

SUMMARY OF THE INVENTION

One aspect of the present invention is as a method of enabling sensing of at least one parameter in an exterior annulus of a well between a tubular structure in the well and the wall of the borehole of the well. This method comprises moving a portion of at least one fiber optic cable into the exterior annulus such that the portion is placed to conduct an optical signal responsive to at least one parameter in the exterior annulus.

Such a method can be more particularly defined as comprising: moving a fiber optic sensor into an exterior annulus of a well between a tubular structure in the well and the wall of the borehole of the well; conducting light to the fiber optic sensor from a light source; and receiving an optical signal from the fiber optic sensor in response to the conducted light and at least one parameter in the exterior annulus.

The present invention also provides a method of treating a well, comprising: using, during a treatment time period, a cementing process; moving a disposable fiber optic sensor into an annulus of the well undergoing the treatment with the fluid of the cementing process; and sensing with the disposable fiber optic sensor at least one parameter in the annulus.

It is to be further understood that other fiber media can be used within the scope of the present invention.

Various objects, features, and advantages of the present invention will be readily apparent to those skilled in the art in view of the foregoing and the following description read in conjunction with the accompanying drawings.

DETAILED DESCRIPTION OF THE INVENTION

Figure 1:
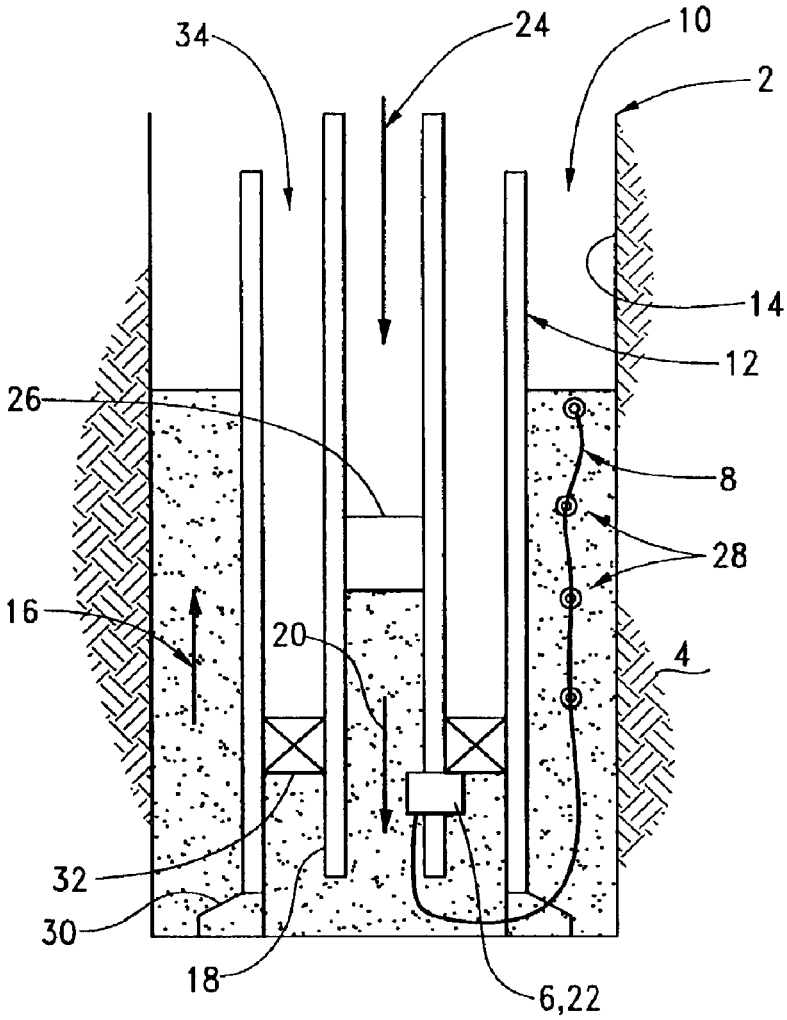
FIG. 1 represents a fiber optic cable carried by cementing treatment fluid into the exterior annulus of a well, wherein the fiber optic cable is from a fiber dispensing device located down in the well.

FIG. 1 represents a cementing process applied to a well 2 in a formation 4, during which process one or more fibers are dispensed from one or more fiber dispensing devices 6 located in the well 2 (only one fiber and only one fiber dispensing device 6 are shown in the drawings for simplicity). Such fiber and the present invention will be further described with reference to one or more fiber optic cables 8 as the presently preferred embodiment of fiber (the term "fiber optic cable" as used in this description and in the claims includes the cable's optical fiber or fibers, which may alone have parameter sensing capabilities, as well as any other sensor devices integrally or otherwise connected to the optical fiber(s) for transport therewith, as well as other components thereof, such as outer coating or sheathing, for example, as known to those skilled in the art). The portion of the illustrated fiber optic cable 8 is moved into the exterior annulus 10 of the well 2 such that the fiber optic cable 8 is placed to conduct a signal responsive to at least one parameter in the exterior annulus 10. The exterior annulus 10 includes the region between a tubular structure 12 (for example, casing or liner) and the wall 14 of the borehole of the well 2. The parameter to be measured can be any one or more phenomena that can be sensed using fiber optic technology or technology compatible therewith. Non-limiting examples are pressure, temperature, and chemical activity (for example, chemical and ionic species).

Movement of the fiber optic cable 8 is typically upward in the exterior annulus 10 as represented by arrow 16 in FIG. 1; however, it could move downhole from an uphole or surface location if fluid flow were in that direction in the exterior annulus 10 (for example, in the case of reverse cementing process). The fiber optic cable 8 can be moved by any technique suitable for transporting the fiber optic cable 8 into the exterior annulus 10. One technique of moving the fiber optic cable 8 includes flowing a fluid down a pipe or tubing string 18 in the well 2 and then around a lower end of the pipe or tubing string 18 and up the exterior annulus 10 as is done in conventional cementing processes, but then also carrying by the flowing fluid the portion of the fiber optic cable 8 into the exterior annulus 10. This is represented in FIG. 1 by a fluid 20 (flowing in the direction indicated by the arrow) carrying the fiber optic cable 8 from a spool 22 embodying the fiber dispensing device 6 near the end of the pipe or tubing string 18. This fluid 20 flows in response to pressure applied by and via a forcing fluid 24 (flowing in the direction indicated by the arrow) and a spacer 26 in a manner known in the art. Although one fiber optic cable 8 may be enough to be carried into exterior annulus 10, multiple cables can be used to ensure interception by the flowing fluid and transport into the desired part of the exterior annulus 10 (for example, three fiber optic cables 8 positioned or oriented 120° apart relative to the circumference of the well 2 such that at least one of them moves into the exterior annulus 10 with flowing cementing fluid 20).

The fluid 20 can be of any type having characteristics sufficient to carry at least one fiber optic cable 8 in accordance with the present invention. Such fluid can be at different pressures and different volume flow rates. At least some specific inventive embodiments are particularly directed to fluids used in cementing processes in oil or gas wells, such as cement and foam cement (for example, cement with compressed nitrogen). These processes and fluids are known in the art.

In FIG. 1, the illustrated fiber optic cable 8 is mounted in the fiber dispensing device 6, such as including the spool 22, that is located downhole. Associated light source and measurement electronics (not shown in FIG. 1) can be located either at the surface or downhole. Light reflecting from optical sensors 28 (or intrinsic sensing portion of the fiber optic cable 8 itself) contains information regarding the sensed parameter, such as pressure and temperature, for example.

Telemetry is provided to get signals from a downhole location to the surface. In the example of FIG. 1, there is a separate communication that must be effected from the downhole spool 22 to the surface. Any suitable telemetry, whether wired or wireless, can be used. Non-limiting examples include electromagnetic telemetry, electric line, acoustic telemetry, and pressure pulse telemetry, not all of which may be suitable for a given application. For example, radio frequency short hop link may be used to relay the data from downhole optical detection equipment to an electric line. As another example, an electrical wet metallic connector may be used. Considering other non-limiting examples, wireless transmission methods such as acoustic telemetry through tubing or fluid, or electromagnetic telemetry, or a combination of any of these can also be used. As another example, an optical wet connect can be used to establish the communication link between the downhole equipment and a wireline that extends to the surface and the surface equipment. Such wireline can be armored and contain at least one optical fiber, one part of the optical wet connect, and a sinker bar. When this wireline tool stabs into the downhole tool containing the fiber dispensing device 6 and the other part of the optical wet connect, the fiber optic cable 8 is optically connected through the optical fiber(s) of the wireline to the optical signal equipment (such as through an optical coupler to a light source and optical signal receiver) located at the surface in this example. Thus, no downhole optical processing is required. This simplifies the downhole portion of the system and places the optical signal processing equipment at the surface, away from the adverse conditions typically found downhole. So, in this illustration, by whatever means used, the signals are sent to surface equipment, such as including a computer (such as via a wireline modem when electric line is used).

In FIG. 1 the fiber dispensing device 6 is shown located downhole near cementing shoe 30 and packer 32 (or other sealing device for interior annulus 34 between pipe or tubing string 18 and tubular structure 12) at the bottom of the tubular structure 12. Using the downhole fiber dispensing device 6 enables a shorter overall length of fiber optic cable 8 to be used than if the fiber dispensing device 6 were farther up the pipe or tubing string 18 or at the surface. However, a length in excess of 100 meters might still be used downhole because the length of the carried portion of the fiber optic cable 8 might extend the length of the exterior annulus 10, which could be several thousand feet. Any suitable fiber optic cable 8 configuration may be used, one non-limiting example of which includes multiple spools of fiber optic cables 8 deployed for a single treatment, wherein the length of fiber optic cable 8 in each fiber dispensing device 6 is different to enable penetration to various distances in the exterior annulus 10.

Figure 2:
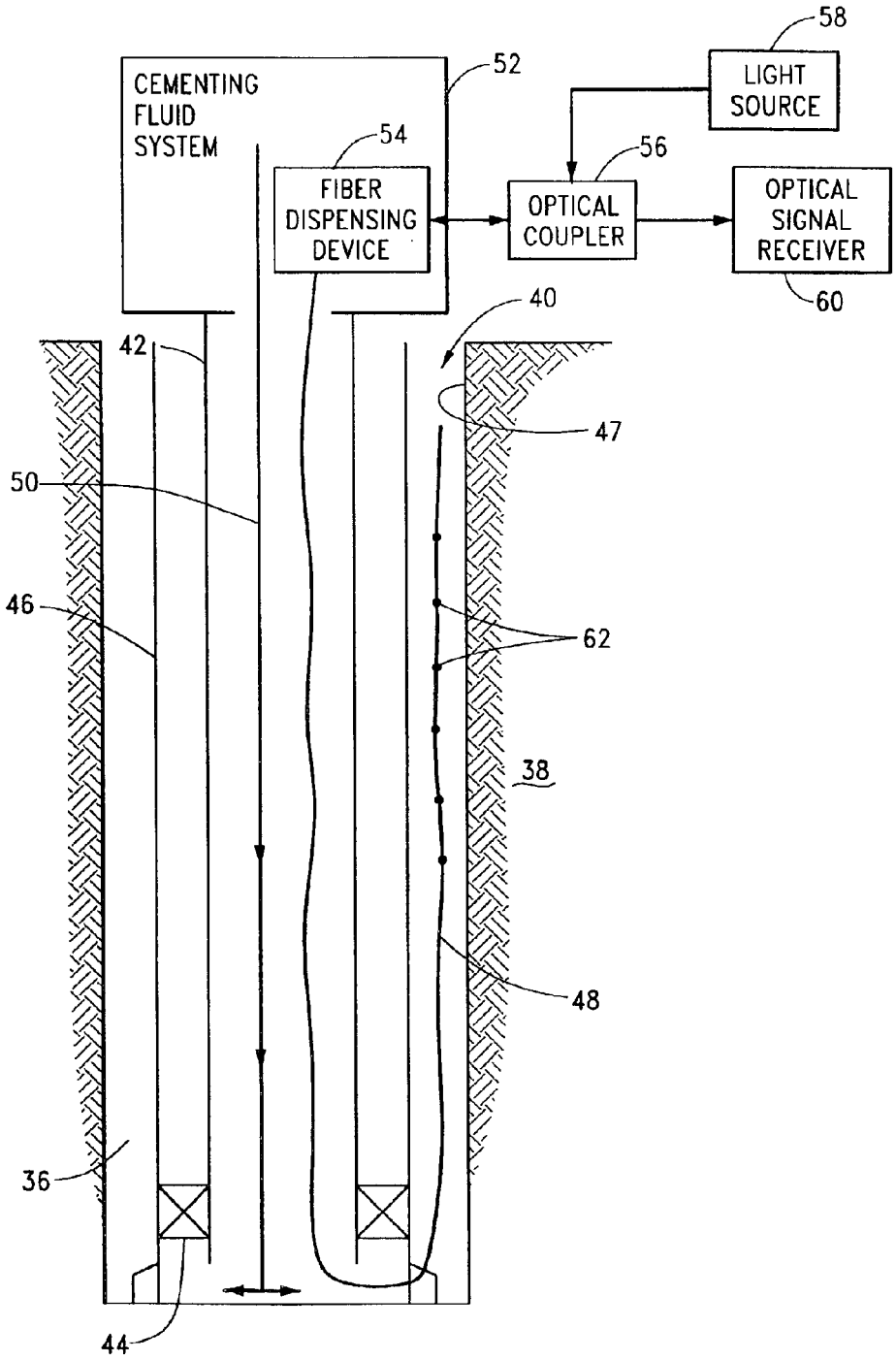
FIG. 2 represents a fiber optic cable carried by cementing treatment fluid into the exterior annulus of a well from a fiber dispensing device at the surface.

Referring to FIG. 2, a well 36 intersects a formation 38 relative to which an exterior annulus 40 is defined. Disposed in the well 36 are a pipe or tubing string 42, packer 44, and an outer tubular structure 46, such as casing or liner, for example, each of which is of a type and use known in the art. The space between the outer tubular structure 46 and wall 47 of the borehole of the well 36 defines the exterior annulus 40.

A fiber optic cable 48 is moved into the exterior annulus 40 by a cementing fluid 50 (flowing in the direction indicated by the arrow). The cementing fluid 50 comes from a cementing fluid system 52 that includes one or more pumps as known in the art. In the FIG. 2 embodiment, associated with the cementing fluid system 52 is a fiber dispensing device 54. In one implementation this includes a spool of the fiber optic cable 48 housed such that the fiber optic cable 48 readily unspools, or uncoils, (at least a portion of it) as the cementing fluid 50 is pumped and flows along or through it. An end of the fiber optic cable 48 remains at the original location of the fiber dispensing device 54, and that end is connected through an optical coupler 56 (which splits and couples light signals as known in the art) to a light source 58 and an optical signal receiver 60. This embodiment of FIG. 2 involves deploying from the surface at least a portion of the disposable fiber optic cable 48 with integral fiber optic sensors 62 (or in which the fiber optic cable 48 itself is the sensor) into the exterior annulus 40 during the cementing treatment.

The viscous drag of the cementing fluid 50 unspools and transports the leading end of the fiber optic cable 48 down the well 36 inside the pipe or tubing string 42 that carries the cementing fluid 50 which then flows into the exterior annulus 40. This leading end of the fiber optic cable 48, with its sensors 62 or intrinsic sensing fiber, is dispensed into the exterior annulus 40 when the cementing fluid 50 flows up the exterior annulus 40. As the fiber optic cable 48 is placed and after cementing fluid 50 has stopped flowing, the fiber optic cable 48 can sense conditions in the exterior annulus 40. Such sensing can occur by effects on the optical signal returned by the fiber optic cable 48 from the sensors 62 or sensing portion thereof, whereby the condition causing the effect can be measured in real time during the cementing process and thereafter as long as the fiber optic cable 48 remains capable of providing such sensing.

The light source 58 and optical signal receiver 60 are located uphole and are connected to the fixed end of the fiber optic cable 48 at the fiber dispensing device 54. As one type of signal, light reflecting back from the sensors 62 (or intrinsic sensing portion) constitutes an optical signal that contains information regarding pressure and temperature, for example, which is assessed uphole. No downhole optical processing equipment is required in this embodiment. This simplifies the downhole portion of this system and places the optical signal processing equipment at the surface, away from high temperatures, pressures, mechanical shock and vibration, and chemical attack typically encountered downhole.

So, the respective fiber optic cable source can be located either in the well or outside the well (such as at the surface). To be placed in the respective exterior annulus, the respective fiber optic cable is pulled from its dispensing device, such as by the force of fluid flowing along and engaging it.

To use optical signaling in the aforementioned fiber optic cables 8, 48, light is conducted to the fiber optic sensor portion thereof from a light source (for example, light source 58 in FIG. 2), and an optical signal from the fiber optic sensor is received in response to the conducted light and at least one parameter in the exterior annulus 10, 40. Such optical signal includes a portion of the light reflected back from the sensor or sensing portion of the optical fiber, the nature of which reflected light is responsive to the sensed parameter. Non-limiting examples of such parameters include pressure, temperature, and chemical activity in the exterior annulus 10, 40 and fluid therein. The light source can be disposed either in the well or outside the well, and the same can be said for the optical signal receiver. Typically both of these would be located together; however, they can be separated either downhole or at the surface or one can be downhole and the other at the surface. The light source and the optical signal receiver can be of types known in the art. Non-limiting examples of a light source include broadband, continuous wave or pulsed laser or tunable laser. Non-limiting examples of equipment used at the receiving end include intrinsic Fabry-Perot interferometers and extrinsic Fabry-Perot interferometers. For multiple fiber optic sensors, the center frequency of each fiber optic sensor of a preferred embodiment is set to a different frequency so that the interferometer can distinguish between them.

The fiber optic cable 8, 48 of the embodiments referred to above can be single-mode or multiple-mode, with the latter preferred. Such fiber optic cable can be silicon or polymer or other suitable material, and preferably has a tough corrosion and abrasion resistant coating and yet is inexpensive enough to be disposable. Such fiber optic cable 8, 48 does not have to survive the harsh downhole environment for long periods of time because in the preferred embodiment of the present invention it need only be used during the time that the treatment process is being applied; however, broader aspects of the present invention are not limited to such short-term sensing (for example, sensing can occur as long as the fiber sensor functions and related equipment is in place and operating). This longer term sensing can be advantageous, such as to monitor for cement setting or hardening conditions.

Figure 3:
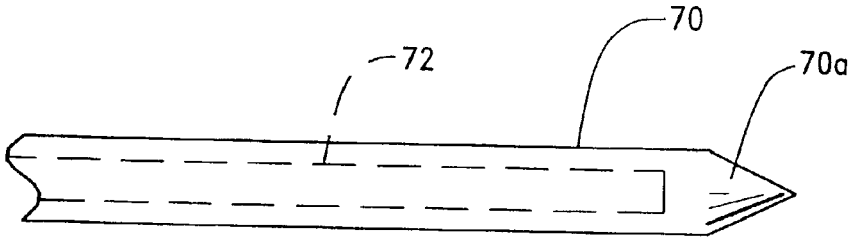
FIG. 3 represents a leading end of a fiber optic cable housed in one embodiment of a carrier conduit.
Figure 4:
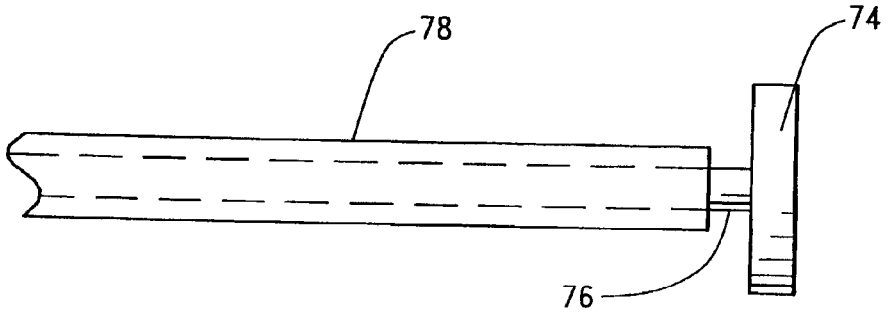
FIG. 4 represents a leading end of a fiber optic cable to which a drag member is connected and about which another embodiment of carrier conduit is disposed.

Such fiber optic cable can include, but need not have, some additional covering. One example is a thin metallic or other durable composition carrier conduit that facilitates insertion of the fiber optic cable into the well or the exterior annulus. For example, the end of the fiber optic cable to be projected into the exterior annulus can be embedded in a very thin metal tube to reinforce this portion of the optical fiber (such as to prevent bending past a mechanical or optical critical radius) and yet to allow compression of the fiber in response to exterior annulus pressure, for example. As another example, the fiber and the carrier conduit can be moveable relative to each other so that inside the exterior annulus the carrier conduit can be at least partially withdrawn to expose the fiber. Such a carrier conduit includes both fully and partially encircling or enclosing configurations about the fiber. Referring to FIG. 3, a particular implementation can include a titanium open or closed channel member 70 having a pointed tip 70*a* and carrying the end of an optical fiber 72. Another example, shown in FIG. 4, is to have a drag member 74 attached to the end of an optical fiber 76 and to have a carrier conduit 78 behind it, whereby the transporting fluid engages the drag member 74 when emplacing the optical fiber 76 but whereby the carrier conduit 78 can be withdrawn (at least partially) once the optical fiber 76 with the drag member 74 is in place and held by surrounding material, for example.

To use the spooling configuration referred to above, fiber optic cable 8, 48 is preferably coiled in a manner that does not exceed at least the mechanical critical radius for the fiber optic cable 8, 48 and that freely unspools or uncoils as the fiber optic cable 8, 48 is moved into the respective well 2, 36. A somewhat analogous example is a spool of fishing line. The use of the term "spool" or the like does not imply the use of a rotatable cylinder but rather at least a compact form of the fiber optic cable that readily releases upon being pulled into the well. With regard to fiber optic cable spooling, see for example U.S. Pat. No. 6,041,872 to Holcomb, incorporated in its entirety herein by reference.

Non-limiting examples of optical sensors 28, 62 that can be used for the aforementioned embodiments include a pressure sensor, a cable strain sensor, a microbending sensor, a chemical sensor, or a spectrographic sensor. Preferably these operate directly within the optical domain (for example, a chemical coating that swells in the presence of a chemical to be sensed, which swelling applies a pressure to an optical fiber to which the coating is applied and thereby affects the optical signal); however, others that require conversion to an optical signal can be used. Non-limiting examples of specific optical embodiments include fiber Bragg gratings and long period gratings.

Although the foregoing has been described with reference to one treatment in a well, the present invention can be used with multiple treatments in a single run. Furthermore, multiple spools or other sources of fiber optic cable can be used. When multiple fiber optic cables or spools are used, they can be used in combination or respectively, such as by dedicating one or more to respective zones of treatment.

Although the foregoing has been described with regard to optical fiber technology, broadest aspects of the present invention encompass other conductive fibers and technologies, including conductive carbon nanotubes. Broadly, the conductive fiber may be defined to conduct one or more forms of energies, such as optical, electrical, or acoustic, as well as changes in the conducted energy induced by parameters in the exterior annulus.

Thus, the conductive fiber of the present invention can include one or more of optical fiber, electrical conductor (including, for example, wire), and acoustical waveguide.

In general, those skilled in the art know specific equipment and techniques with which to implement the present invention.

Thus, the present invention is well adapted to carry out objects and attain ends and advantages apparent from the foregoing disclosure. While preferred embodiments of the invention have been described for the purpose of this disclosure, changes in the construction and arrangement of parts and the performance of steps can be made by those skilled in the art, which changes are encompassed within the spirit of this invention as defined by the appended claims.

What is claimed is:

1. A method of sensing at least one parameter in an annulus of a well between a tubular structure in the well and the wall of a borehole of the well, comprising the step of moving a portion of at least one fiber optic cable into the annulus such that the portion will contact a fluid placed in the annulus, wherein the fluid will contact the wall of the borehole of the well and the tubular structure, the portion of at least one fiber optic cable being placed to conduct an optical signal responsive to the at least one parameter in the annulus.

2. The method as defined in claim 1, wherein the step of moving the portion of at least one fiber optic cable includes the steps of:

flowing the fluid into the annulus; and carrying by the flowing fluid the portion of at least one fiber optic cable into the annulus.

3. The method as defined in claim 2, wherein the step of flowing the fluid into the annulus includes the step of pumping a cementing fluid into the annulus.

4. The method as defined in claim 2, wherein the step of carrying the portion of at least one fiber optic cable includes the step of pulling fiber optic cable from a spool thereof by using the force of the flowing fluid engaging the fiber optic cable.

5. The method as defined in claim 4, wherein the spool of fiber optic cable is disposed in the well.

6. The method as defined in claim 4, wherein the spool of fiber optic cable is outside the well.

7. The method as defined in claim 1, wherein the step of moving the portion of at least one fiber optic cable includes the steps of:

moving a carrier conduit into the annulus; and cariying the portion of at least one fiber optic cable into the annulus in the carrier conduit.

8. The method as defined in claim 1, wherein the portion of at least one fiber optic cable includes at least one sensor to measure at least one of a physical characteristic, chemical composition, material property, or disposition in the annulus.

9. A method of sensing at least one parameter in an annulus of a well between a tubular structure in the well and the wall of the borehole of the well, comprising the steps of:

moving a fiber optic sensor into the annulus with a flowing fluid, wherein the flowing fluid contacts an outer surface of the tubular structure and the wall of the borehole;

conducting light to the fiber optic sensor from a light source; and receiving an optical signal from the fiber optic sensor in response to the conducted light and at least one parameter in the annulus.

10. The method as defined in claim 9, wherein the step of moving the fiber optic sensor includes the step of pumping the fluid into the well the fluid comprising a cementing fluid.

11. The method as defined in claim 9, wherein the step of moving the fiber optic sensor includes the steps of:

moving a carrier conduit into the annulus; and carrying the fiber optic sensor into the annulus in the carrier conduit.

12. The method as defined in claim 9, wherein the light source is disposed in the well.

13. The method as defined in claim 9, wherein the light source is disposed outside the well.

14. The method as defined in claim 9, wherein the optical signal is received in the well.

15. The method as defined in claim 9, wherein the optical signal is received outside the well.

16. The method as defined in claim 9, wherein the step of moving the fiber optic sensor includes the step of pulling fiber optic cable from a spool thereof by using the force of flowing fluid engaging the fiber optic cable.

17. The method as defined in claim 16, wherein the spool of fiber optic cable is disposed in the well.

18. The method as defined in claim 16, wherein the spool of fiber optic cable is outside the well.

19. A method of treating a well, comprising the steps of:

using, during a treatment time period, a cementing process;

moving a fiber optic sensor into an annulus of the well undergoing the treatment with a fluid of the cementing process; and sensing with the fiber optic sensor at least one parameter in the annulus.

20. The method as defined in claim 19, further comprising the step of leaving the fiber optic sensor in the annulus after the treatment time period to degrade such that the fiber optic sensor has a useful life only during the treatment time period.

21. The method as defined in claim 19, wherein the step of moving the fiber optic sensor includes the step of pumping the fiber optic sensor with the cementing fluid.

22. The method as defined in claim 19, wherein the step of moving the fiber optic sensor includes the step of transporting the fiber optic sensor within a carrier conduit that is moved into the annulus with the fiber optic sensor.

23. A method of sensing at least one parameter in an annulus of a well between a tubular structure in the well and the wall of the borehole of the well, comprising:

flowing a fluid into the annulus: and carrying by the flowing fluid a portion of at least one conductive fiber into the annulus, such that the portion is placed to conduct a signal responsive to the at least one parameter in the annulus, wherein the flowing fluid contacts the tubular structure and the wall of the borehole of the well.

24. The method as defined in claim 23, wherein the step of flowing a fluid into the annulus includes the step of pumping a cementing fluid into the annulus.

25. The method as defined in claim 23, wherein the step of carrying the portion of at least one conductive fiber includes the step of pulling a fiber optic cable from a spool thereof by using the force of the flowing fluid engaging the fiber optic cable.

26. The method as defined in claim 25, wherein the spool of fiber optic cable is disposed in the well.

27. The method as defined in claim 25, wherein the spool of fiber optic cable is outside the well.

28. The method as defined in claim 23, wherein the step of moving the portion of at least one conductive fiber includes the steps of:

moving a carrier conduit into the annulus; and carrying the portion of at least one conductive fiber into the annulus in the carrier conduit.

29. The method as defined in claim 23, wherein the at least one conductive fiber includes at least one sensor to measure at least one of a physical characteristic, chemical composition, material property, or disposition in the annulus.

30. The method as defined in claim 23, wherein the at least one conductive fiber includes an optical fiber.

31. The method as defined in claim 23, wherein the at least one conductive fiber includes an electrical conductor.

32. The method as defined in claim 23, wherein the at least one conductive fiber includes conductive carbon nanotubes.

33. The method as defined in claim 23, wherein the at least one conductive fiber includes an acoustical conductor.

* * * * *